US008783548B2

(12) United States Patent
Billen

(10) Patent No.: US 8,783,548 B2
(45) Date of Patent: Jul. 22, 2014

(54) SPORTS CAR CARTON

(71) Applicant: William D. Billen, Topeka, KS (US)

(72) Inventor: William D. Billen, Topeka, KS (US)

(73) Assignee: Kid Stuff Marketing, Inc., Topeka, KS (US)

( * ) Notice: Subject to any disclaimer, the term of this patent is extended or adjusted under 35 U.S.C. 154(b) by 0 days.

(21) Appl. No.: 13/720,143

(22) Filed: Dec. 19, 2012

(65) Prior Publication Data

US 2014/0166735 A1 Jun. 19, 2014

(51) Int. Cl.
*B65D 5/42* (2006.01)
*A63H 33/16* (2006.01)

(52) U.S. Cl.
USPC ..... 229/116.4; 229/904; 446/80; 446/488

(58) Field of Classification Search
USPC ..... 229/116.4, 904; 206/457, 557, 562, 206/563; 446/75, 76, 78, 80, 487, 488; D9/672, 675, 676, 677
See application file for complete search history.

(56) References Cited

U.S. PATENT DOCUMENTS

| | | | | | |
|---|---|---|---|---|---|
| 979,812 | A * | 12/1910 | Warren | 229/116.4 |
| 1,330,654 | A * | 2/1920 | Pittman | 446/488 |
| 2,118,821 | A * | 5/1938 | Ringler | 229/116.4 |
| 3,224,660 | A * | 12/1965 | Willis et al. | 229/116.3 |
| 4,055,250 | A * | 10/1977 | Mayhew | 206/457 |
| 4,804,133 | A * | 2/1989 | Kiyokane | 229/116.4 |
| 5,454,508 | A * | 10/1995 | Billen | 229/116.4 |
| 5,622,256 | A * | 4/1997 | Tesar | 206/457 |
| 8,511,537 | B2 * | 8/2013 | Billen | 229/116.4 |
| 2004/0195144 | A1 * | 10/2004 | Smith | 229/904 |
| 2008/0029643 | A1 * | 2/2008 | Billen | 244/1 R |
| 2008/0257941 | A1 * | 10/2008 | Billen | 229/116.4 |

* cited by examiner

*Primary Examiner* — Gary Elkins
(74) *Attorney, Agent, or Firm* — Erickson Kernell Derusseau & Kleypas, LLC

(57) ABSTRACT

A carton assembled from semi-rigid material presents a sports car configuration and is formed from a sheet of the semi-rigid material that presents a base panel having spaced, opposed lateral edges presenting fold lines from which side panels are folded upwardly to present the sides of the sports car body. Each of the side panels has replicas of a front and a rear wheel to support the sports car on an underlying surface. The hood of the sports car extends downwardly and inwardly, and a rear panel folds downwardly to present the rear end of the sports car body thereby providing an assembled carton having the sports car configuration.

12 Claims, 6 Drawing Sheets

SPORTS CAR CARTON

This invention relates to a carton which is assembled from a sheet of cardboard-like material and has the shape and style of a sports car and is formed from side-by-side panels which, when assembled, present a sports car configuration having a cabin for receiving food or other items.

BACKGROUND OF THE INVENTION

Cardboard trays and cartons having a sports car appearance hold food and other items for the convenience and interest of customers, children in particular, of fast-food restaurants. Designs displayed on the tray or carton create this interest and present designs and artwork that a child will recognize and enjoy. The carton for food or other items presents a unique and appealing sports car configuration in which the cabin behind the wheel is designed to receive food or other items.

SUMMARY OF THE INVENTION

In an embodiment of the present invention a carton having a space for holding food items is formed from semi-rigid sheet material having fold lines therein whereby front, rear, side, and top elements are formed that present a sports car configuration in which the space in the carton for holding the food or other items of interest is provided by an open compartment behind the steering wheel and windshield.

In another aspect of the invention, the sports car-like carton is formed by providing a sheet of semi-rigid material folded by the user to present a base panel, first and second laterally spaced side panels, and replicas of the front and rear wheels of the sports car for supporting the carton on a surface upon which the sports car may be placed.

In another aspect of the present invention a panel is folded to a position overlying a frontal portion of the carton and is shaped to present a hood of the carton at the front end thereof.

In a further aspect, the hood includes an upper, downwardly and forwardly extending nose portion and a lower, downwardly and rearwardly extending nose portion to thereby present a streamlined front end configuration.

In yet another aspect of the invention, the hood extends forwardly and downwardly over the side panels and is secured to a base panel to present a tapered hood presenting the front end of the sports car carton, and a cabin opening is provided rearwardly of the hood for holding food or other items.

In still another aspect of the invention, a simulated spoiler is provided that extends rearwardly and upwardly from the upper panel at the rear thereof and has opposed outer ends that are secured to the sheet to present the sports car configuration.

Additionally, in yet another aspect of the invention a spoiler extends rearward and upward at the rear end of the carton between the side panels to provide the sports car-like appearance.

Other features of the sports car carton and method of forming the same will become apparent from the following description taken in connection with the accompanying drawings, wherein is set forth by way of illustration and example, an embodiment of the present invention.

DETAILED DESCRIPTION

Figure 1:
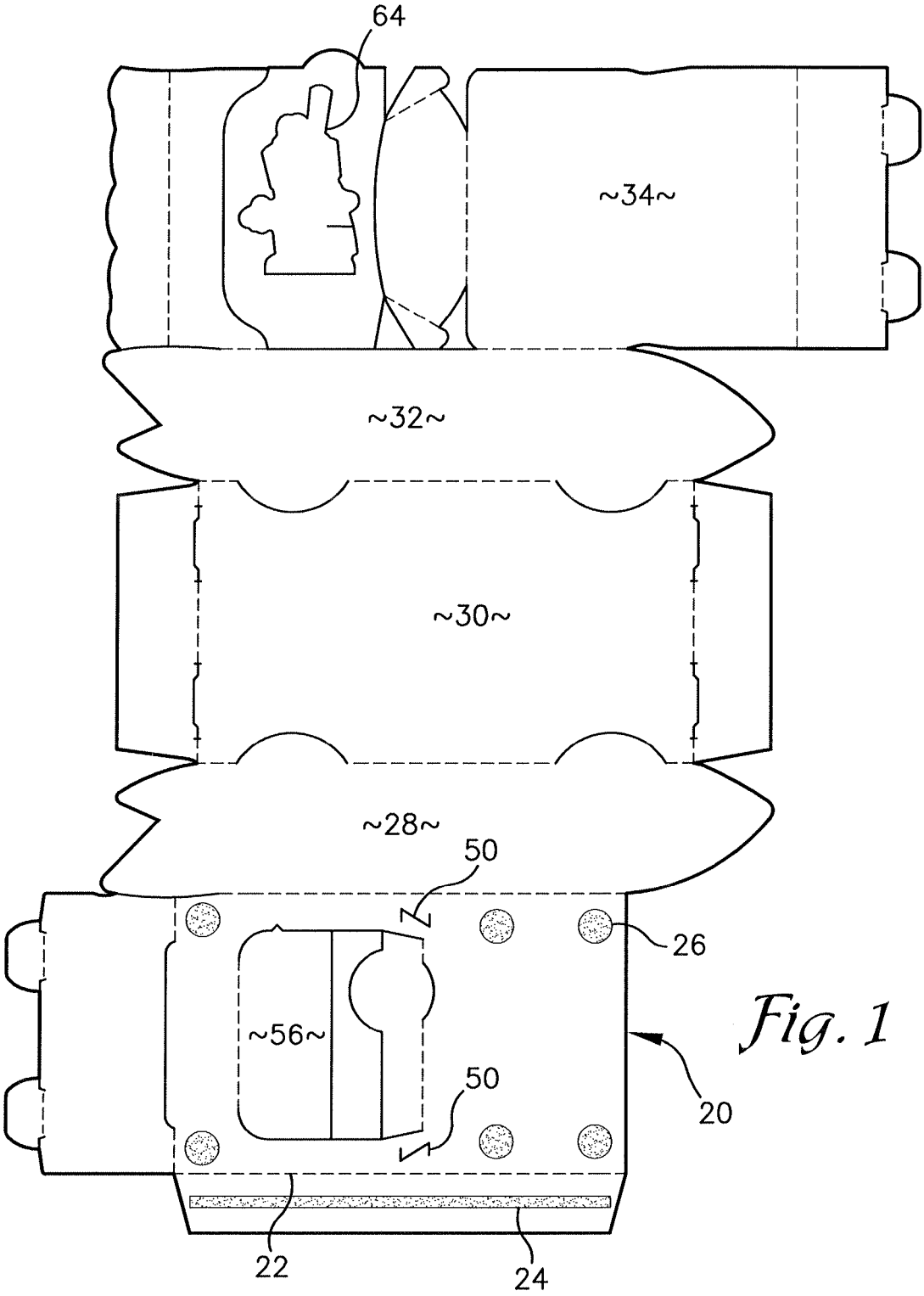
FIG. 1 is a plan view of a sheet of paperboard showing the panel components and other elements of an embodiment of the carton before the components are folded and connected to one another to form the sports car carton of the present invention.

Referring to the drawings, FIG. 1 is a plan view of a sheet of paperboard from which the carton of the present invention is formed by folds made along parallel fold lines to present panels as will be described hereinbelow, and additional elements to form a carton having a sports car configuration for holding snacks, candy and other items of particular interest to children. Three embodiments of the invention to be set forth hereinbelow are referred to hereinafter as Shaker, Goldie and Sizzle. These are containers for food or other items of interest, particularly to children, and also provide space for holding food or these items of interest and provide an external display surface for decorative and advertising material.

The shaker embodiment is shown in FIG. 1 before assembly along fold lines to be set forth below. A first upper panel 20 has a rectangular configuration and has a front to rear fold line 22 at its outer longitudinal edge and a glue line 24 along its outer edge, plus points where glue is applied prior to assembly at, for example, each of six, small spaced circular areas 26. If desired, a lesser number of such circular areas, such as four, may be provided. A first side panel 28, a base panel 30, a second side panel 32, and a second upper panel 34 complete the components of the paperboard sheet prior to assembly into a completed sports car carton. The broken lines in FIG. 1 are fold lines as may be appreciated from FIGS. 2-7 and 8-11 showing the stages of folding the various elements of the carton to present the finished product.

Figure 2:
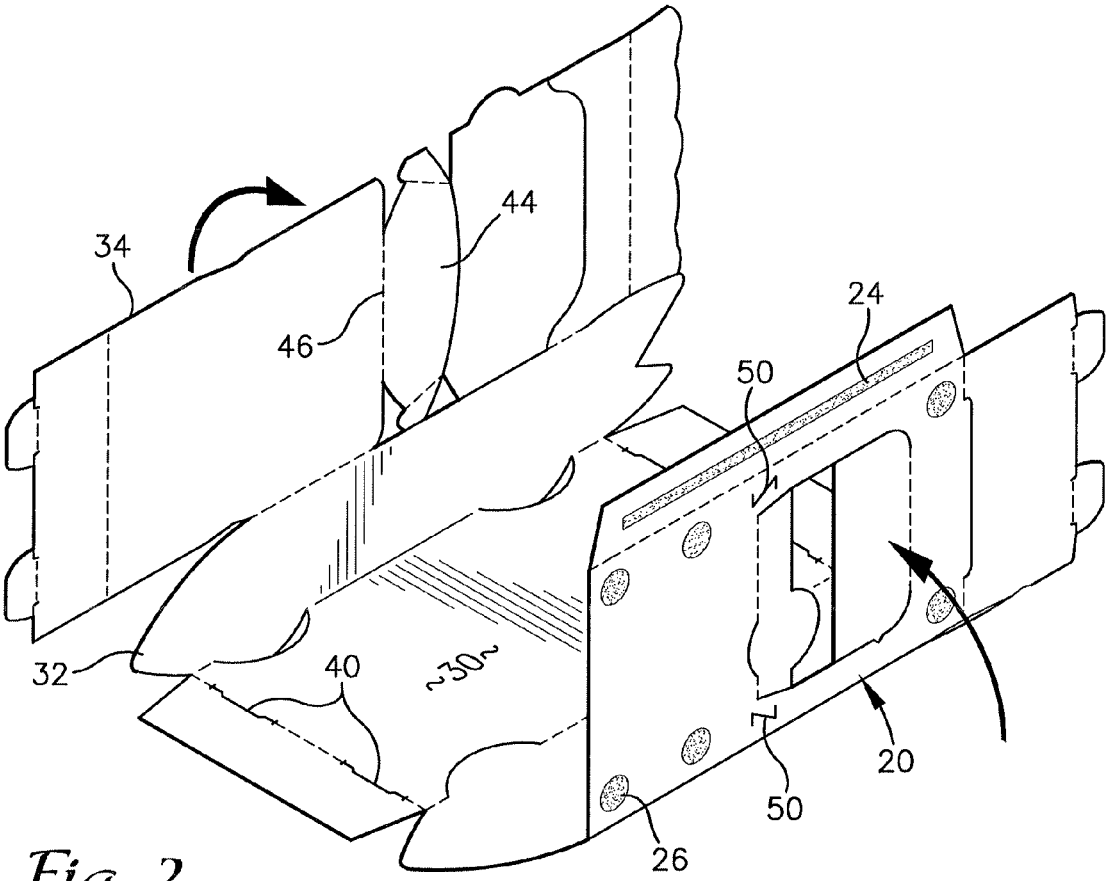
FIG. 2 shows the initial folds of outer components of the paperboard sheet in the assembly of the carton.
Figure 3:
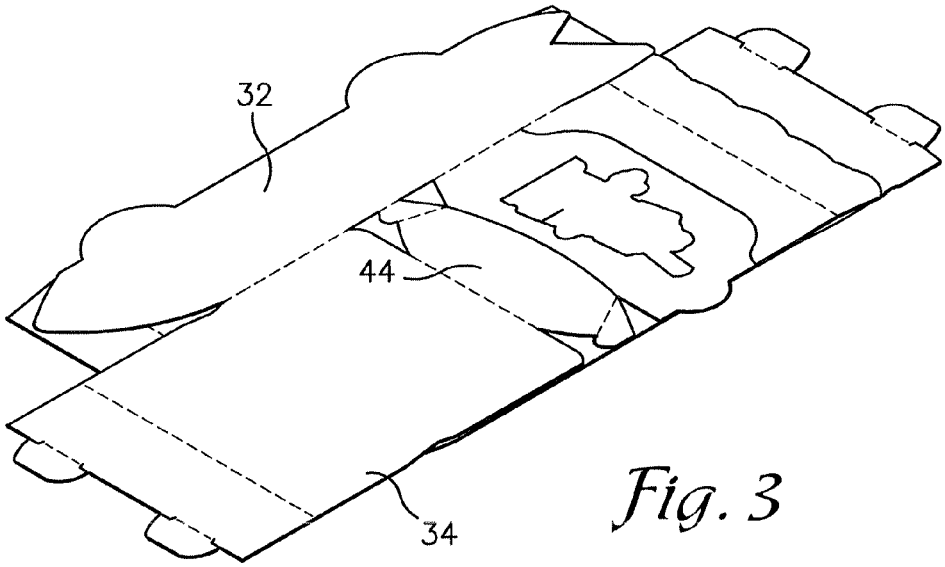
FIG. 3 shows further folds of the outer components of the paperboard sheet which results in two flat layers of the carton components.
Figure 4:
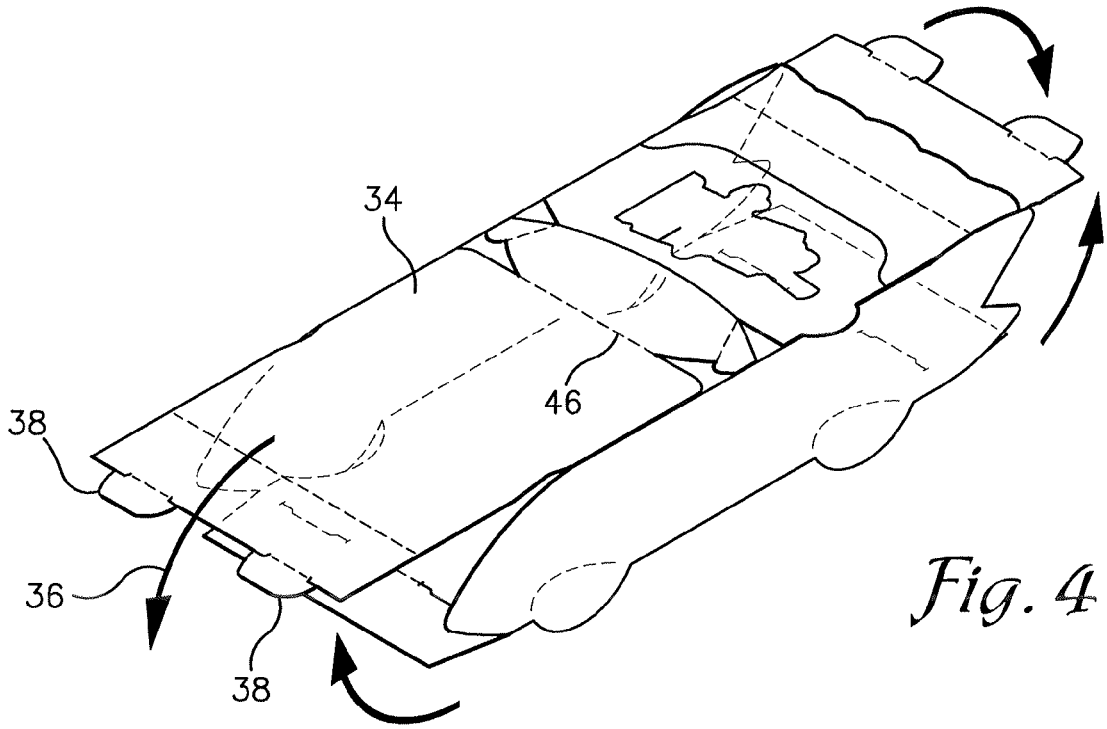
FIG. 4 shows the next step in construction wherein the partially assembled carton presents a top, a bottom and opposed side panels.
Figure 5:
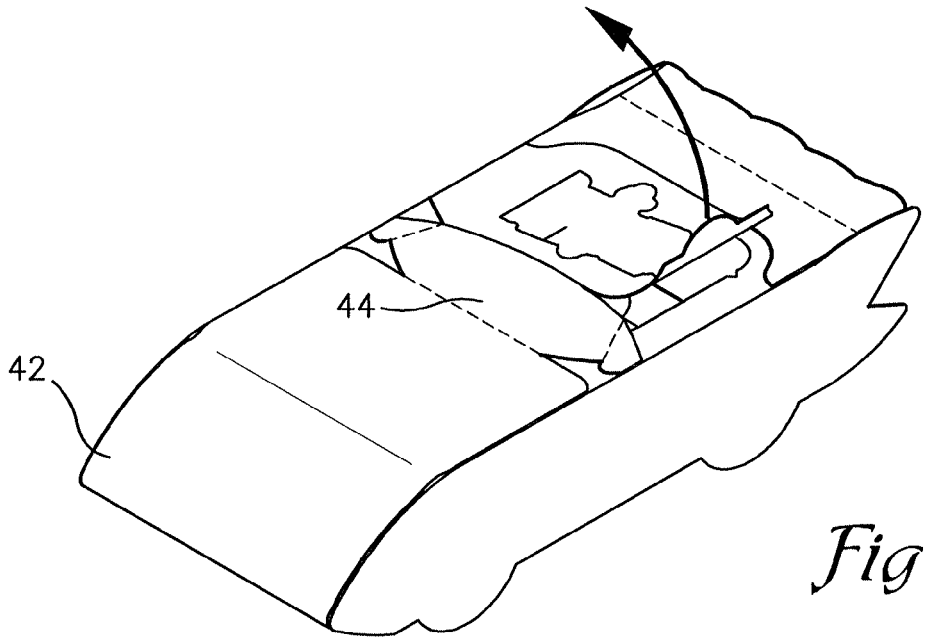
FIG. 5 shows the next step in which the hood and rear end are formed.

FIGS. 2-5 show the stages of the folding of the elements to present, upon assembly, a paperboard carton having a sports car configuration as seen in FIG. 5. The first stage of the assembly is folding a first upper panel 20 and the opposed, rear end panel 34 inwardly as shown in FIG. 2 followed by a completion of the initial fold as seen in FIG. 3 wherein the second side panel 32 now overlies the base panel 30. In a subsequent step, the configuration shown in FIG. 3 is expanded to present the body of the vehicle shown preliminarily in FIG. 4 and in the final configuration in FIG. 5 where all four wheels 33 support the vehicle. In the final configuration the front end panel 34 presents the nose of the vehicle by folding the front end downwardly as illustrated by the arrow 36 in FIG. 4 to present the hood of the vehicle by insertion of the two spaced frontal tabs 38 into mating slots 40 (see FIG. 2) to present the finished, assembled hood 42 (FIG. 5).

Figure 6:
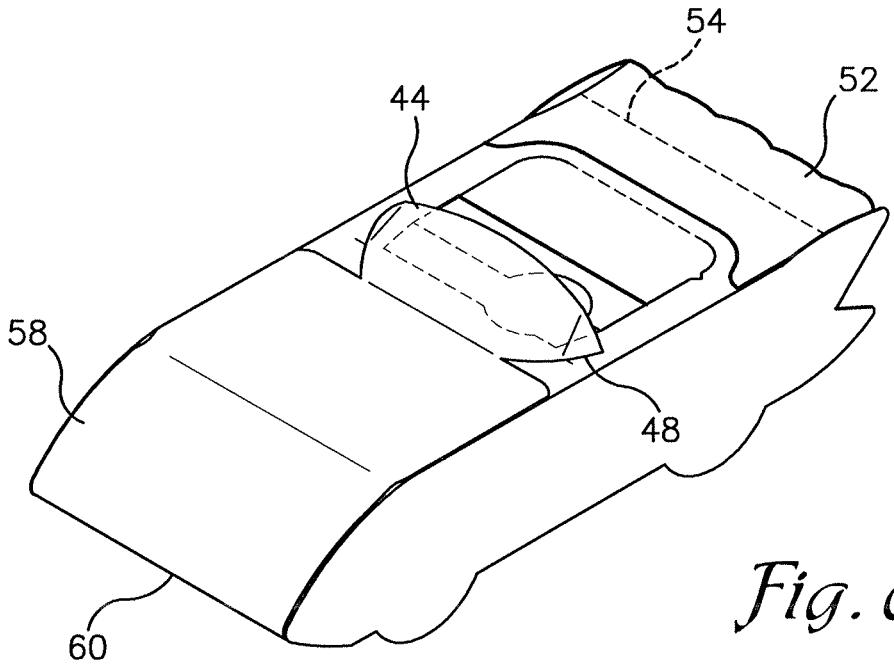
FIG. 6 shows a further step wherein the windshield is in place.
Figure 7:
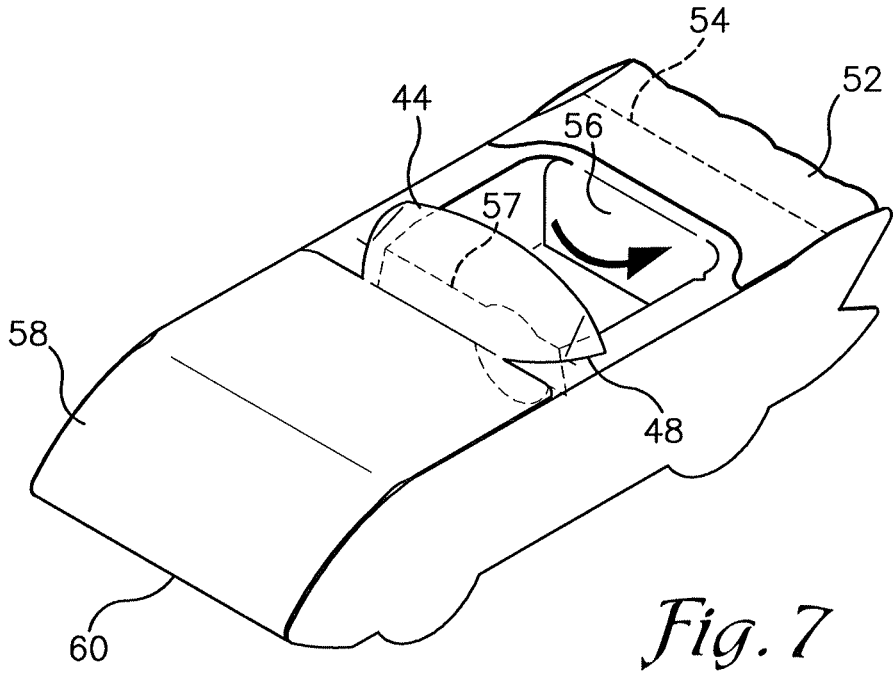
FIG. 7 shows a still further step in the assembly of the sports car carton wherein the back seat is folded down and in place.

A windshield 44 is a component of the panel 34 and is folded at line 46 to the upstanding position illustrated in FIGS. 6 and 7 and held in place by opposed elements 48 which are received respectively by, for example, Z-shaped slots 50 (FIGS. 1 and 2) in panel 20. A spoiler 52 at the rear end of the carton vehicle is pivoted upwardly along a fold line 54 to complete the assembly of the sports car carton. Additionally, an optional rear panel 56 and a dashboard 57 are shown in FIG. 7 folded downwardly into place to the rear of the windshield 44 to complete the assembly, as illustrated by the bold arrow.

Figure 8:
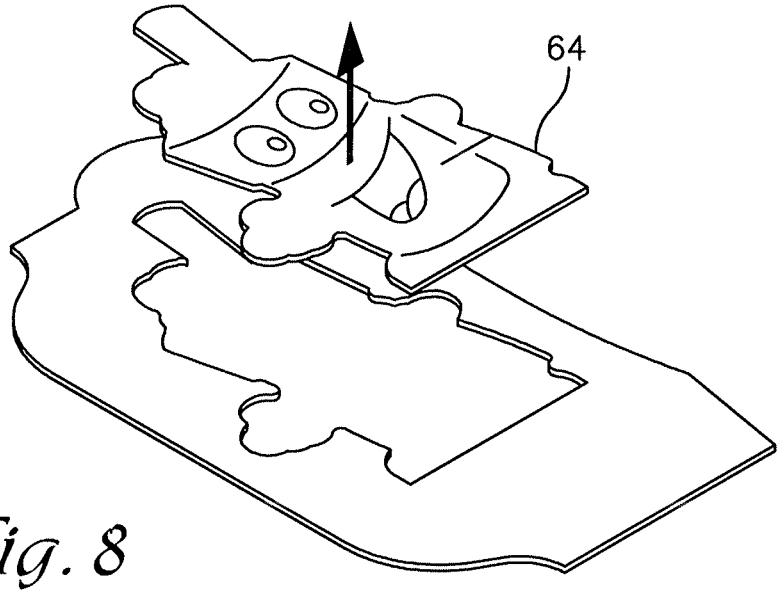
FIG. 8 shows a punch out of a figure representing the driver of the sports car carton.
Figure 9:
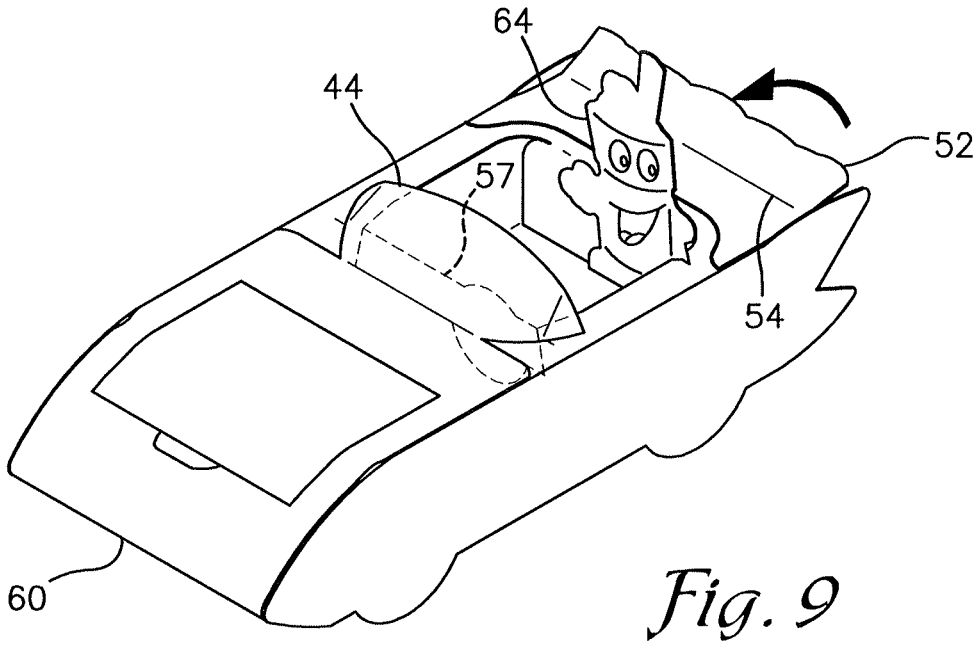
FIG. 9 shows the carton fully assembled.
Figure 10:
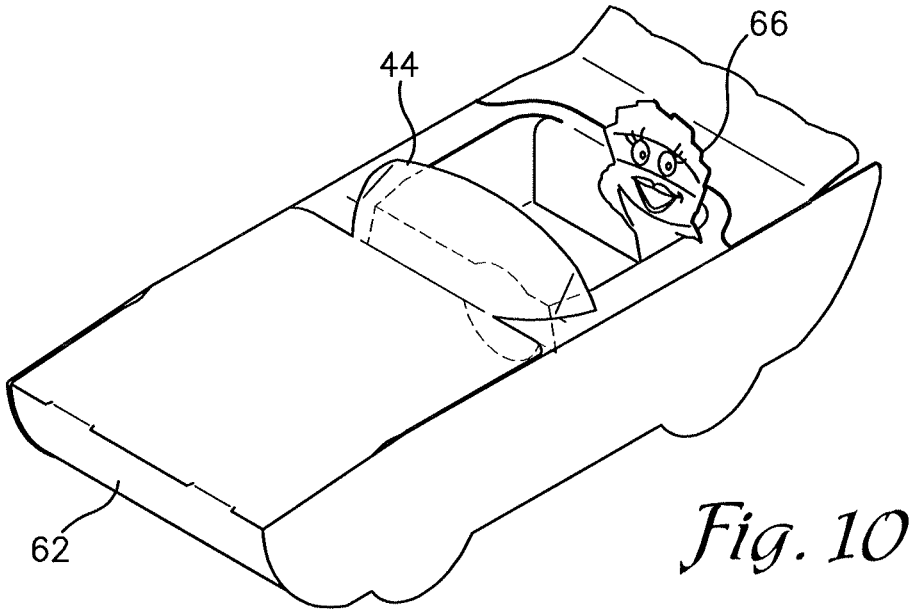
FIG. 10 shows a carton similar to the carton of the FIG. 9 with a first modified embodiment of front end.
Figure 11:
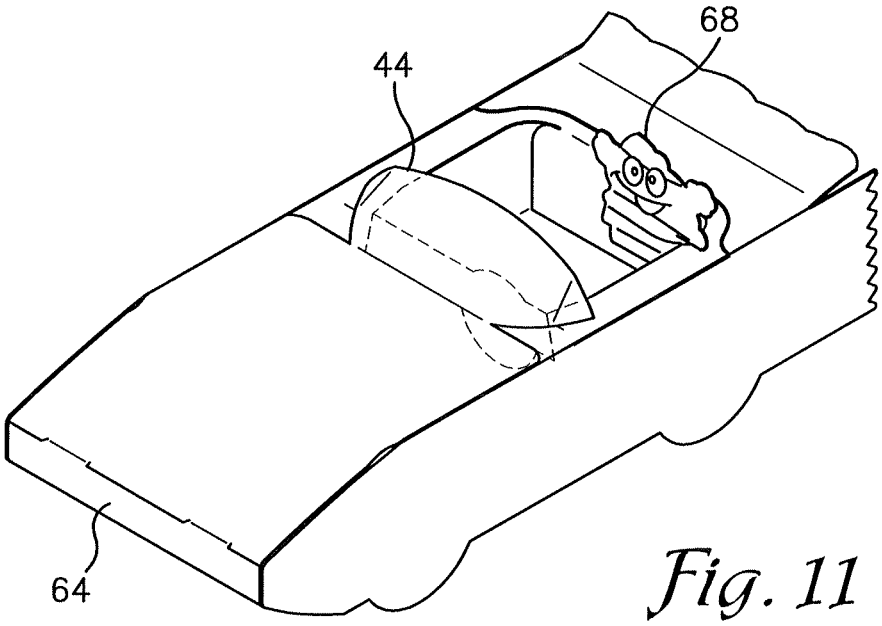
FIG. 11 shows a carton similar to the carton of FIG. 9 with a second modified embodiment of the front end.

The assembled views of FIGS. 5, 6 and 7 present a sports car carton having a front hood 58 that slopes down to the front end 60 and then downwardly and rearwardly to present a sharply tapered V-shaped front end 60 as seen in FIGS. 6, 7 and 9. Alternatively, a front end presented by a full curve 62 may also be provided (FIG. 10) or a flat, horizontal nose 64 as seen in FIG. 11. FIGS. 9, 10 and 11 also illustrate three characters which may be added to the back seat to add interest to the car, particularly for children, shown in FIG. 9 as "shaker" as represented by the milkshake 64, "goldie" 66 as represented by the image of a girl, and "sizzle" 68 as represented by the illustrated character. Accordingly, the addition of these or other images of interest to children add to the character and appeal of the sports car carton. The present invention, therefore, provides a fanciful carton for food or other items of interest to children and thus contributes to the enjoyment and amusement of the user. Additionally, FIG. 8 illustrates an example of a punch-out for a milkshake 64 ("shaker") which is added to the car 60 upon assembly thereof.

It is to be understood that while certain forms of this invention have been illustrated and described, it is not limited thereto, except insofar as such limitations are included in the following claims.

The invention claimed is:

1. A carton for food or other items presenting a sports car configuration having a body extending from front to rear, said carton comprising:

a sheet of semi-rigid material presenting a base panel having spaced, opposed lateral edges presenting generally parallel, first and second fold lines, a first side panel at one side of said base panel folded upwardly at said first fold line to present one side of the sports car body and presenting a third fold line generally parallel to said first fold line, a first upper panel folded at said third fold line to a position overlying and generally parallel to said base panel and having a free edge, a second side panel laterally spaced from said first side panel and folded upwardly at said second fold line to present the opposite side of the sports car body and presenting a fourth fold line generally parallel to said second fold line, a second upper panel folded at said fourth fold line to a position overlaying said first upper panel, each of said first and second side panels having replicas of a front wheel and a rear wheel of the sports car thereon for supporting the carton on a surface upon which the sports car carton may be placed, said first upper panel having a front portion, a middle portion behind said front portion having an opening to present a compartment for receiving food or other items, and a rear portion behind said middle portion, said second upper panel having a hood portion, a center portion behind said hood portion and covering said opening of said first upper panel, and a rear portion, and a rear end panel folded downwardly from said first upper panel rear portion to present a rear end of the sports car body, whereby to provide an assembled carton having a sports car configuration.

2. The carton as claimed in claim 1, wherein said second upper panel hood portion extends downwardly and inwardly to present a front end configuration of the sports car.

3. The carton as claimed in claim 1, wherein said second upper panel hood portion includes an upper, downwardly and forwardly extending nose portion, and a lower, downwardly and rearwardly extending nose portion to thereby present a front end configuration of the sports car carton.

4. The carton as claimed in claim 1, wherein said second upper panel hood portion extends forwardly and downwardly from said first upper panel over said side panels and is secured to said base panel to present a tapered hood presenting the front end of the sports car carton, said first upper panel having an opening therein rearward of said first upper panel front portion for holding food or other items, and a simulated windshield portion extending rearwardly and upwardly from a rear of said second upper panel hood portion and having opposed outer ends secured to said first upper panel middle portion, whereby to present the sports car configuration.

5. The carton as claimed in claim 1, said first upper panel having a dashboard in said compartment behind said first upper panel front portion.

6. The carton as claimed in claim 1, a spoiler between said left and right side panels and extending rearwardly from said second upper panel rear portion.

7. The carton as claimed in claim 1, wherein each of said panels is composed of paperboard.

8. The carton as claimed in claim 1, wherein said second upper panel middle portion includes a removable portion.

9. The carton as claimed in claim 8, wherein said second upper panel removable portion is a cartoon character.

10. The carton as claimed in claim 8, wherein said removable portion is insertable into said compartment.

11. The carton as claimed in claim 1, wherein said second upper panel middle portion includes a windshield behind said second upper panel hood portion.

12. The carton as claimed in claim 11, wherein said windshield includes first and second opposed elements insertable into first and second slots in said first upper panel middle portion.

* * * * *